United States Patent [19]

Winkelman

[11] 4,372,041

[45] Feb. 8, 1983

[54] WIRE CONVEYING CLAMP AND APPARATUS FOR ASSEMBLY OF ACCURATELY SIZED WIRE ENDS TO A TERMINAL

[75] Inventor: John H. Winkelman, Hartland, Wis.

[73] Assignee: Artos Engineering Company, New Berlin, Wis.

[21] Appl. No.: 245,252

[22] Filed: Mar. 19, 1981

[51] Int. Cl.[3] ..... H01R 43/04

[52] U.S. Cl. ..... 29/747; 29/564.4; 29/564.6; 29/753; 29/759; 81/9.51; 198/478; 198/653; 198/695; 198/696

[58] Field of Search ..... 29/749, 564.4, 564.6, 29/753, 759, 857, 863; 81/9.51; 198/479, 478, 653, 695, 696

[56] References Cited

U.S. PATENT DOCUMENTS

| | | | |
|---|---|---|---|
| 3,232,451 | 2/1966 | Andren | 198/479 X |
| 3,267,556 | 8/1966 | Scharf | 29/564.4 X |
| 3,283,398 | 11/1966 | Andren | 198/696 X |
| 3,693,231 | 9/1972 | Scharf | 29/564.6 X |
| 4,164,808 | 8/1979 | Gudmestad et al. | 81/9.51 X |
| 4,164,808 | 8/1979 | Gudmestad et al. | 29/564.4 |
| 4,175,316 | 11/1979 | Gudmestad | 29/564.4 |
| 4,308,659 | 1/1982 | Brandewie et al. | 29/759 X |

*Primary Examiner*—Francis S. Husar
*Assistant Examiner*—Carl J. Arbes
*Attorney, Agent, or Firm*—James E. Nilles

[57] ABSTRACT

The invention provides wire conveying clamp assemblies for high speed conveying of accurately sized wire leads and for precisely presenting the leads for mass termination, as for example to the terminals on a terminal block. The clamp assemblies are secured to an endless chain that rotates in a flat orbital path, and each assembly includes a side plate support fixedly attached to the chain, and a clamp housing slideably attached to that side plate support. The clamp housing is slideably movable along the side plate support in a direction parallel to the path of movement of the chain. A clamp arm is slideably mounted on the housing, and guide pin means are slideably engaged in the arm. A comb for engaging wire leads is attached to one end of the guide pin means, and pusher means move the comb and the guide pin means transversely relative to the chain path to cause separation of the free ends of the wire leads.

23 Claims, 17 Drawing Figures

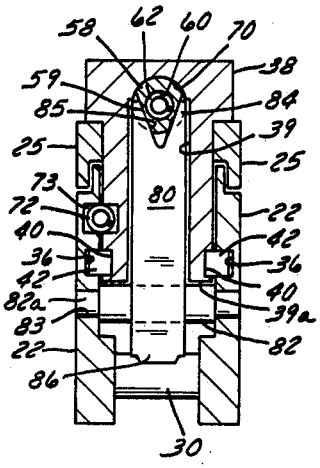
FIG. 10
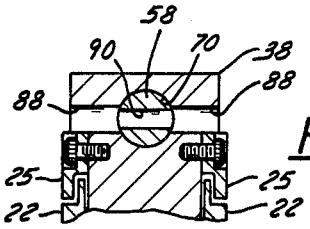
FIG. 11
FIG. 17
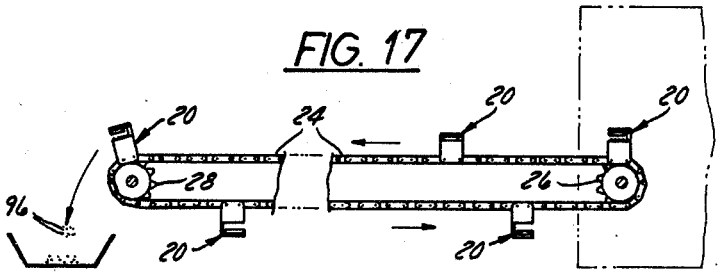
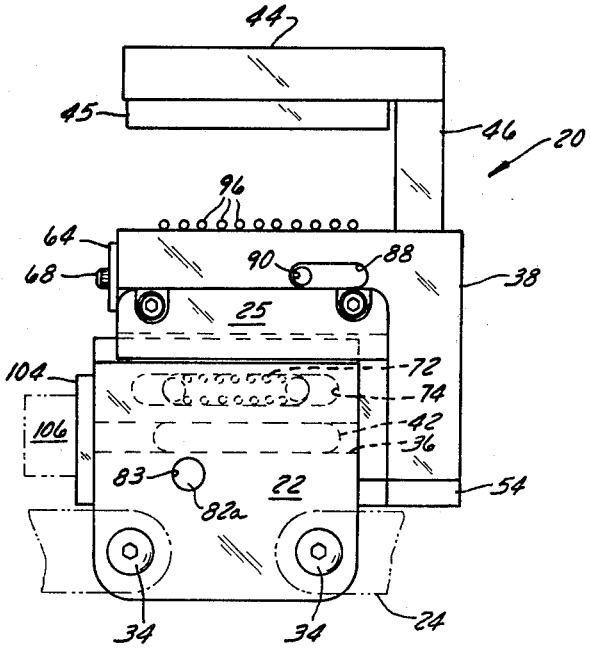
FIG. 12

WIRE CONVEYING CLAMP AND APPARATUS FOR ASSEMBLY OF ACCURATELY SIZED WIRE ENDS TO A TERMINAL

BACKGROUND OF THE INVENTION

1. Field of Use

The invention relates generally to a wire conveying clamp assembly for conveying accurately sized electrical wire leads and precisely positioning them in respect to a wire terminal.

2. Description of the Prior Art

Various types of apparatus exist for mass production of insulated electrical wire leads having electrical terminals attached to one or both ends of each lead. Such apparatus typically includes a reel of wire, a feed mechanism for drawing a strand of wire from the reel, a severing mechanism for cutting a wire segment of predetermined length from the strand, a conveyor mechanism having releasable conveyor clamps for gripping the wire segment and for conveying it to a wire stripping mechanism wherein one or both ends are stripped of insulation and then to a terminal attachment mechanism wherein electrical terminals are attached to one or both stripped ends of the wire segment, whereupon the finished lead is conveyed to a collecting station and the conveyor clamps open to deposit the finished lead thereat. Such an apparatus is disclosed and claimed in U.S. Pat. No. 4,164,808 issued on Aug. 21, 1979, to Gudmestad et. at.

Presently known machines of this general type have some shortcomings in respect to certain applications. Such prior machines typically comprise a wire-locating member attached to the machine frame and a plurality of clamp assemblies secured to and rotatable with a chain, the chain being entrained about and movable about a pair of sprockets. The prior art clamps immobilize the wires during processing, as for example at the wire stripping and terminal attachment stations, and as the clamps approach the other wire processing stations, the speed of the chain decreases, finally stopping upon reaching each station. At the terminal attachment station, the wire locating member is designed to move downwardly and towards the wires, engaging their insulated portions and ensuring that they are properly positioned so that the wires may be attached to the terminals.

The wire segments during processing are held in generally parallel, adjacent relationship on a clamp assembly between a clamp housing and a vertically movable clamp arm. Although the spacing of adjacent wires is relatively uniform along the portions of their respective lengths that are held between the clamp arm and the clamp housing, the spacing of adjacent wires is not uniform near the wire ends. As the wire locating member of prior art machines is located on the machine frame and not on the clamp, it may approach the insulated wire portions near the wire ends. Because the adjacent wire ends may not be equally spaced, the wire locating member may not properly engage the wires and as a result the wire ends may not be positioned for proper terminal attachment. This problem may be exacerbated by an overly slack chain, causing the wire clamps to stop short of their proper stations. The importance of uniformspacing between wires along their lengths, particularly at the wire ends, and of accurate location of clamps adjacent the stations increases with the number of wires simultaneously processed per clamp and the fineness of the wires processed.

SUMMARY OF THE INVENTION

The invention provides wire conveying clamp assemblies for high speed conveying of accurately sized wire leads and for precisely presenting the leads for mass termination, as for example to the terminals on a terminal block. The clamp assemblies are secured to an endless chain that rotates in a flat orbital path, and each assembly includes a side plate support fixedly attached to the chain, and a clamp housing slidably attached to that side plate support. The clamp housing is slidably movable along the side plate support in a direction parallel to the path of movement of the chain. A clamp arm is slidably mounted on the housing, and guide pin means are slidably engaged in the arm. A comb for engaging wire leads is attached to one end of the guide pin means, and pusher means move the comb and the guide pin means transversely relative to the chain path to cause separation of the free ends of the wire leads.

A more specific aspect of the invention may include a spring-biased bar movable in a vertical slot in the clamp housing. One of the ends of the clamp arm is attached to the bar, and the clamp arm is movable with the bar from an upper, non-wire engaging free position to a lower position in which the wire leads are held between the clamp arm and the clamp housing. A slot may be provided in the back wall of the clamp housing. A projection at the lower end of the bar is guideably moved along the slot. The projection abuts the portion of the housing's back wall defining the upper end of the slot to limit upward movement of the bar.

The clamp housing may also include resilient retaining means, such as a spring-biased retaining pin, for maintaining the clamp arm in the lower position, and pivotable means for pushing the retaining pin towards its biasing spring. A still more specific aspect of the invention may include pin and spring means for returning the clamp housing and the side plate support to their original relative positions after the clamp assembly leaves each of the various wire processing stations.

The clamp assembly is particularly useful when used in combination with an apparatus having a retractible stop. The extended stop engages a front wall of the clamp housing to prevent further movement of that housing and to permit its slidable movement relative to the side plate support. The retracted stop permits the pin and spring means to return the housing and support to their original relative positions and permits the clamp assembly to be moved by the chain to a subsequent wire processing station.

The improved clamp is suitable for separating the adjacent ends of a plurality of fine wires and orienting them so as to ensure accurate termination. The clamp housing holds the wire leads that are to be terminated, and the positioning of the clamp housing relative to the terminal attachment station is determined by the retractible stop rather than by the precise location at which the chain is stopped.

Other objects and advantages of the invention will appear throughout the specification.

BRIEF DESCRIPTION OF THE DRAWINGS

FIG. 10 is a rear sectional view of the clamp assembly of FIG. 6 taken along lines 10—10;

FIG. 11 is a sectional view of a portion of the clamp assembly of FIG. 6 and taken along lines 11—11;

FIG. 12 is an elevational view of a clamp assembly in accordance with the invention, shown after striking a stop attached to the apparatus frame, and further showing the relative motion that has thereby been imparted between the clamp housing and the side plate support;

FIG. 17 is an elevational reduced, schematic view of the apparatus in accordance with the invention, and with a plurality of clamp assemblies having clamp arms in both the upper and lower positions and further showing the sprockets about which the endless chain is entrained.

DESCRIPTION OF A PREFERRED EMBODIMENT

Figure 1:
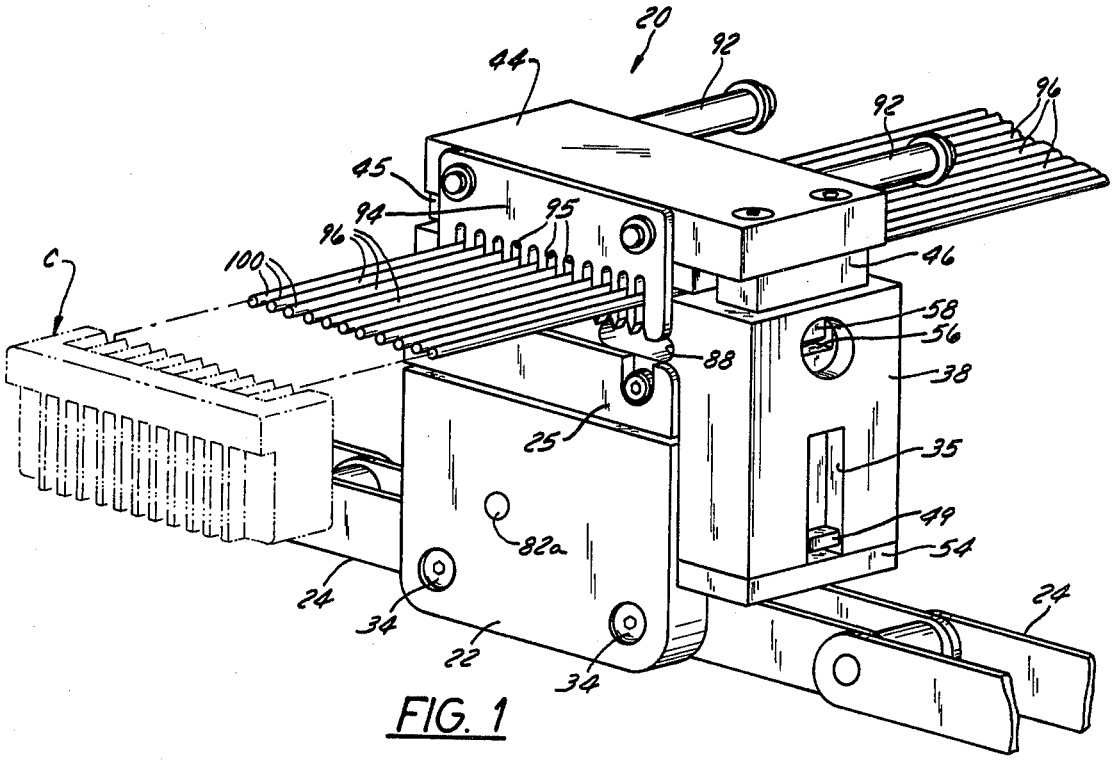
FIG. 1 is a perspective view showing a clamp assembly with the side plate support secured to a chain in accordance with the present invention, with the clamp arm in the lower position and with the comb in a retracted position and engaging the wire leads at a point near the extension of those wire leads from the abutting clamp arm and clamp housing, and also showing a terminal block.
Figure 2:
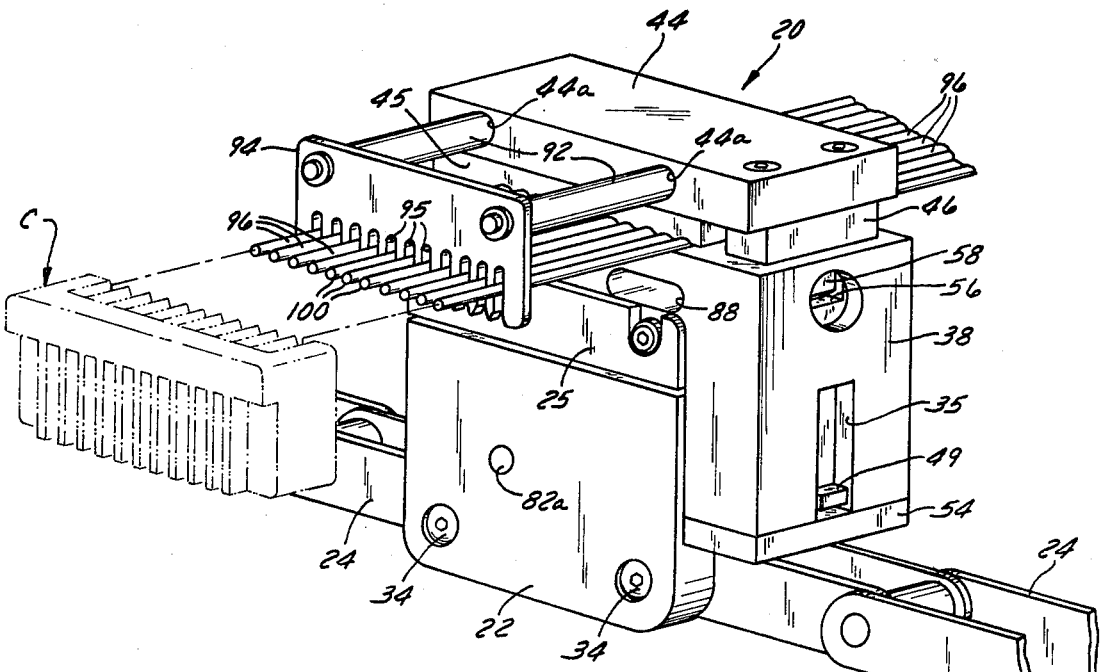
FIG. 2 is a perspective view of the clamp assembly and terminal block of FIG. 1, but with the comb in an extended position to provide for uniform spacing between adjacent wire ends so that they may be accurately positioned in the terminal block.
Figures 3, 4:
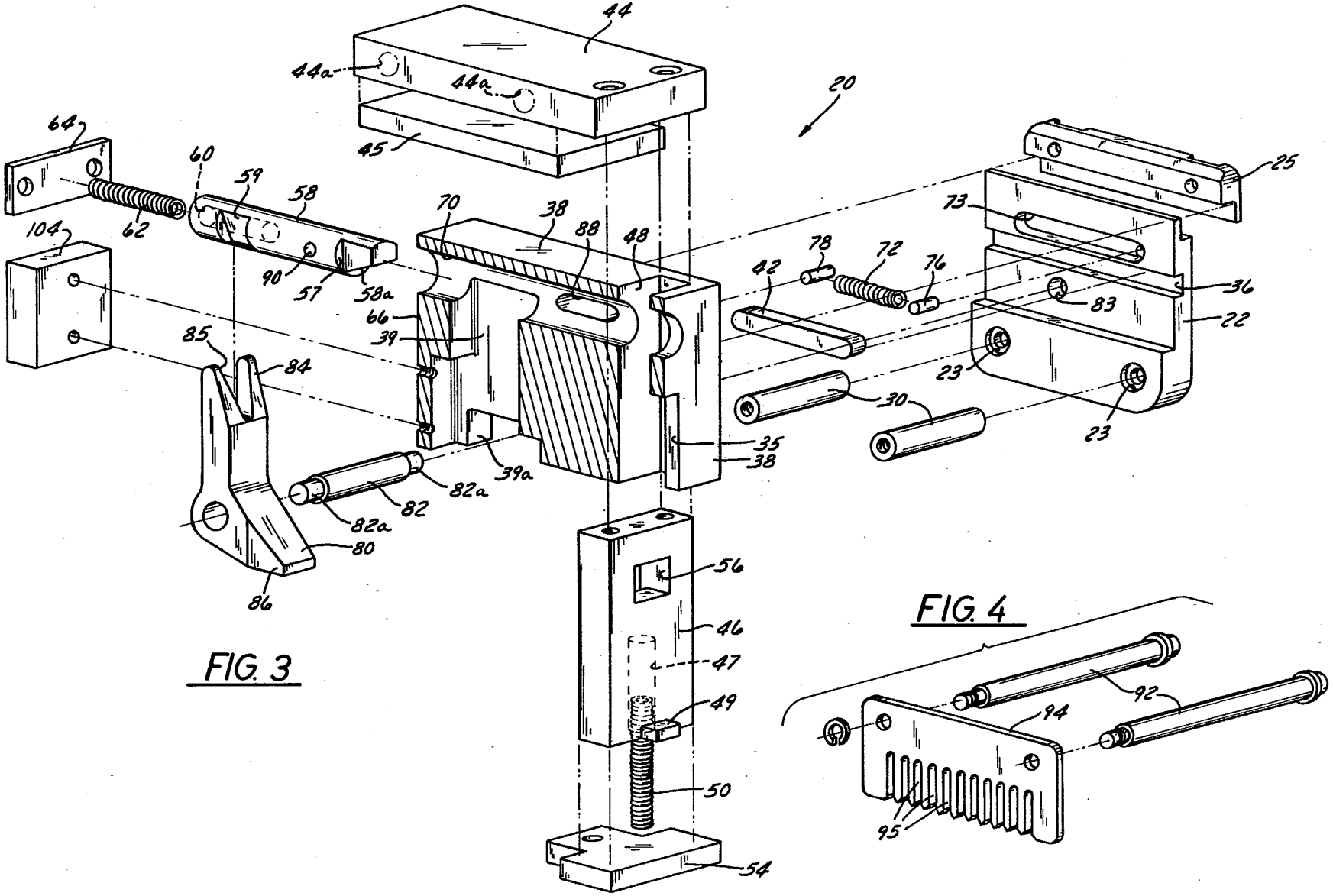
FIG. 3 is an exploded, perspective view, partially in section, of the clamp assembly of FIG. 2, but not including the comb and guide pin means.
FIG. 4 is an exploded, perspective view of the comb and guide pin means of FIG. 2.
Figure 5:
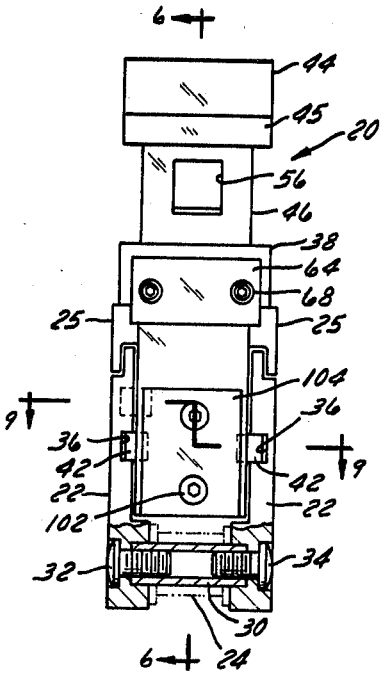
FIG. 5 is a front view, partially in section, of the clamp assembly of FIG. 1, but on a reduced scale and without a comb or guide pin means.
Figure 6:
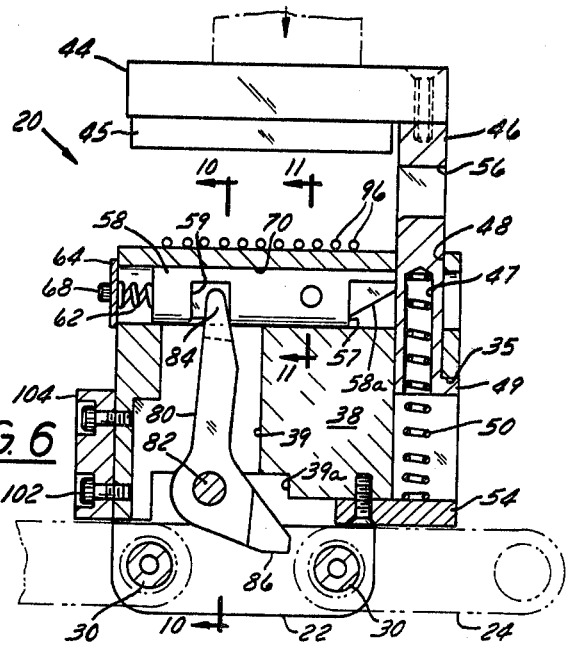
FIG. 6 is a side sectional view of the clamp assembly of FIG. 5 taken along lines 6—6, and with the clamp arm in its upper, non-wire engaging, free position.
Figure 9:
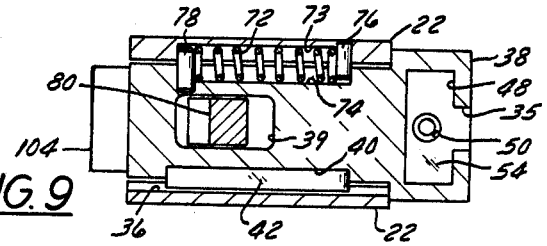
FIG. 9 is a top, sectional view of the clamp assembly of FIG. 5 taken along lines 9—9.
Figure 8:
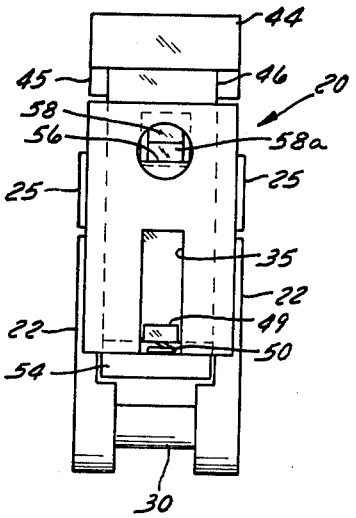
FIG. 8 is a rear, elevational view of the clamp assembly of FIG. 7, and taken along lines 8—8.

The invention finds particular utility when used with apparatus as shown in U.S. Pat. No. 4,164,800, issued to Gudmestad et al on Aug. 21, 1979. Clamp means are provided for transporting the wires to various wire processing stations and securing means are provided for attaching the clamp means to an endless chain. The clamp means comprise a clamp assembly 20, as shown in FIGS. 3 and 5–11, and as shown with wire straightening means in FIGS. 1–2, 4, and 12–16. The clamp assembly 20 includes a pair of side plate supports 22 rigidly secured to an endless chain 24 mounted on a pair of sprockets 26 and 28 for rotation of the chain 24 in a flat, orbital path. A plurality of such clamp assemblies 20 are each secured to the chain 24 by a pair of threaded spacers 30 and four screws 32 and 34, the ends of the spacers 30 each residing in a counterbore 23 in the supports 22.

The apparatus further comprises means for accommodating slideable relative movement between a clamp housing 38 and the side plate supports 22. The clamp housing 38 is slidably movable along the side plate supports 22 in a direction parallel to the path of movement of the chain. Each side plate support 22 includes a first slot 36, and the clamp housing 38 has on each of its side plate support-facing sides a second slot 40 securing a key 42 which is guided in the first slot 36 during the relative slideable movement. A pair of retainers 25 are secured to the housing for maintaining the side plate supports 22 in vertical, parallel relationship.

Vertically movable clamping arm means are provided for alternately immobilizing wire leads on the clamp assembly or releasing them at the end of the wire lead processing. These means comprise a vertically movable clamp arm 44 along which a resilient pad 45 is attached, and one end of which is secured to a bar 46. The bar 46 includes a bore 47 and further includes a tab 49 for limiting upward movement of bar 46 upon engaging the top of a guiding slot 35 in the rear wall of housing 38. The bar is vertically slidably movable within a vertical slot 48 adjacent the rear wall of the clamp housing 38 and is upwardly biased by a spring 50 within bore 47 and abutting a T-shaped spring support 54 secured to the bottom of the clamp housing 38. An orifice 56 is provided in the bar 46 so that one end of a spring-biased retaining pin 58 in the housing may pass through the orifice 56 and maintain the bar 46 and the clamp arm 44 attached thereto in the lower position. The retaining pin 58 includes a notch 59 with a flat engageable, V-shaped surface and further includes a spring receiving hole 60 coaxial with that pin for accommodating its biasing spring 62, the spring 62 abutting a stop plate 64 which is in turn attached to the front wall 66 of the housing 38 with a pair of screws 68. The retaining pin 58 itself is accommodated and slideably mounted in a horizontal bore 70 in the clamp housing 38. Near the end of this bore 70 that is opposite the stop plate 64, the bore 70 intersects the vertical slot 48 so that the pin 58 may pass through the orifice 56 of the bar 46 when that orifice 56 is aligned with bore 70 to maintain the clamp arm 44 in the lower position. Axial travel of the spring-biased retaining pin towards the rear wall of the housing 38 is limited by its flat front stop 57 (FIG. 7) and passage of the pin 58 through the orifice 56 is facilitated by the ramp 58*a* at the orifice-engaging end of the pin 58.

The clamping arm means further comprise a hammer arm 80 pivotally secured about a shaft 82 to the side plate supports 22, and of a substantially L shape. The shaft 82 has reduced diameter ends 82*a* which fit in bores 83 of side support plates 22. The hammer arm has an upper end 84 having a V-shaped notch 85 for engaging the complementary V-shaped notch 59 of the retaining pin and a lower end 86 which is strikable by one of the sprockets. By striking the lower end 86, the sprocket causes pivotal movement of the hammer arm 80 about shaft 82 and causes the withdrawal of the retaining pin from the orifice 56 of bar 46. Housing 38 includes a center slot 39 for hammer arm 80 which intersects bore 70 at its upper end. The bottom of slot 39 includes a cutout 39*a* providing clearance for shaft 82 upon relative slideable movement between housing 38 and side plate support 22. An oval-shaped accessway 88 is provided in each side wall of housing 38 so that a tool may be inserted in a bore 90 in retaining pin 58 to enable manual movement of the latter.

Means are provided for abutting the clamp housing so as to permit relative slideable movement between the housing and the side plate support. As stated above, the side plate support 22 is fixedly secured to the chain and the clamp housing 38 is slidably movable relative to the side plate support. The clamp housing holds the wire leads that are to be terminated, and the positioning of the clamp housing relative to the terminal attachment station is determined by a retractible stop 106, which abuts the housing 38 at pusher pad 104 to stop further forward moement of the housing, rather than by the precise location at which the chain is stopped. The side plate support is moved by the chain slightly beyond the point at which the clamp housing first abuts the extended retractible stop (FIG. 12), causing the relative slidable movement of the support and housing. As a result, if the chain of the present invention were to become somewhat slack, the side plate support would not be positioned quite as far forward as with a taut chain upon reaching the terminal attachment station. The clamp housing, however, would nevertheless be properly positioned relative to the terminal attachment station. The clamp housing would still abut the retractible stop, but there would be less slidable movement of the clamp housing relative to the side plate support than with a properly tensioned chain.

Means are provided for returning the slideably movable clamp housing and side plate support to their original relative positions after the clamp assembly leaves each wire processing station. These means may include a horizontally oriented spring 72 attached to the side plate support and within a spring slot 73 of the support 22 and also within a recessed portion 74 of the housing 38. One end of the spring 72 abuts a pin 76 secured to the side plate support, and the other end abuts a pin 78 secured to the clamp housing 38. Thus, as the pins 76 and 78 are brought toward one another by slideable relative movement of the clamp housing 38 and side plate support 22, spring 72 is compressed. After the stop 106 is retracted, the spring 72 recoils against the pins 76 and 78 to return the support 22 and housing 38 to their original relative positions.

Means are further provided on the clamp assembly for straightening the wire leads prior to their attachment to a terminal block. These means may comprise guide pin means 92 slideably engaged in a pair of lateral guide pin holes 44*a* in clamp arm 44. A comb 94 is attached to one end of the guide pin means 92 and engageable with the wire leads 96, the comb 94 including a plurality of teeth which define slots 95 for engaging wire leads 96. The other end of the guide pin means 92 is acted upon by pusher means 98 to move the comb 94 from its retracted position (FIGS. 13 and 14), where it abuts the clamp arm 44, to its extended position (FIGS. 15 and 16) away from the clamp arm 44, the movement of the comb 94 towards the wire ends 100 straightening and aligning the wire leads 96 along their entire lengths so that they may be properly terminated, as for example by attachment of the wire ends 100 to a connector or terminal block C.

OPERATION OF THE APPARATUS

The apparatus is comprised of a plurality of clamp assemblies 20 for grasping, conveying, and releasing sets of wire leads 96, and which move sequentially to wire processing stations.

Figure 7:
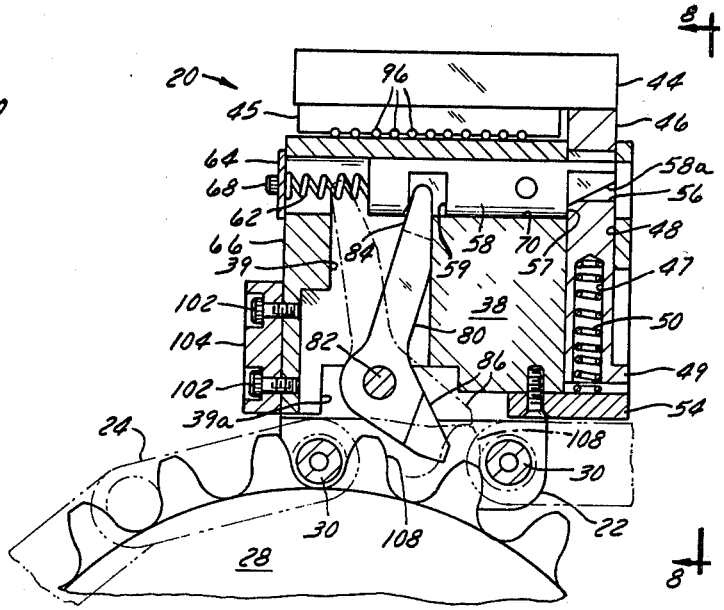
FIG. 7 is a side sectional view of the clamp assembly of FIG. 6, but with the clamp arm in its lower position wherein the clamp arm abuts the top of the clamp housing to immobilize the wire leads.

At the in-feed end of the apparatus adjacent sprocket 26, FIG. 17 assembly 20 has its clamp arm in the upper, non-wire engaging free position (FIG. 17). The wire leads are placed upon the clamp housing 38 and the clamp arm 44 is moved to its lower position (FIG. 7), all by means well known in the art and thoroughly described in the Gudmestad reference referred to above. As the clamp arm 44 is moved into the lower position against the bias of spring 50, bar 46 moves downwardly within vertical slot 48. When orifice 56 is aligned with horizontal bore 70, the spring-biased retaining pin 58 is urged rightwardly with respect to FIGS. 6 and 7 and the tip end of that pin is moved through orifice 56, locking clamp arm 44 in the lower position as shown in FIG. 7. The rightward movement of the pin 58 causes clockwise rotation of the hammer arm 80 about shaft 82 until it is in a cocked position (FIG. 7, hammer arm 84 in solid lines). The lower end 86 of the hammer arm 80 extends between the links of the endless chain 24 and is in position to be contacted by a sprocket tooth 108 after the wire leads 96 have been fully processed and are ready for release from the clamp assembly 20.

The assembly 20 is transported by endless chain 24 to the various wire processing stations with the clamp arm in the lower position. While approaching, for example, the final station or terminal attaching station, the retractible stop 106 is automatically placed in the path of the clamp assembly 20 and above the upper flight of the chain 24. The stop 106 is positioned so as to ensure that a clamp housing 38 abutting that stop cannot move beyond that stop, and so that the housing is precisely at the proper location for attachment of the wire leads 96 to terminal block C. Endless chain 24 automatically moves the side plate support 22 somewhat beyond the point at which the housing 38 makes initial contact with stop 106. Thus, the clamp housing 38 must be movable relative to the side plate support 22. By providing this relatively movable relationship, imprecision in clamp assembly placement due to improper chain tensioning is avoided. Variances in endless chain 24 tension are accommodated by variability in the relative slideable movement of the housing 38 with respect to the support 22.

Retractable stop 106 is shown in place in FIG. 12, and side plate support 22 is shown forward, or to the left, of the point at which pusher pad 104 of housing 38 first contacted the retractible stop 106. After this first contact between pusher pad 104 and retractible stop 106, the clamp housing 38 and the parts connected to or contained within that housing remain stationary relative to retractible stop 106 while the side plate support 22 and the attached hammer arm 80 and shaft 82 move slightly forward, the relative slideable motion between the support 22 and housing 38 guided by key 42 moving in first slot 36.

Figure 16:
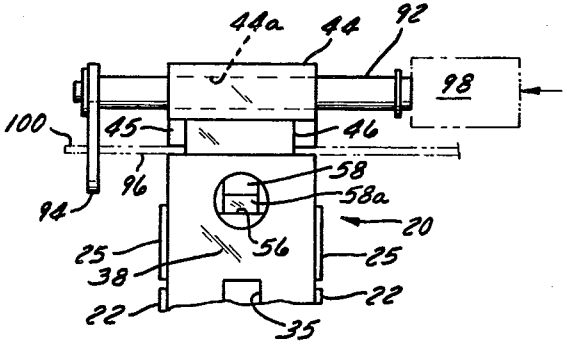
FIG. 16 is a view taken along lines 16—16 in FIG. 15 of the clamp assembly of FIG. 15, and showing the pusher means for slidably extending the guide pin means in the clamp arm.
Figure 15:
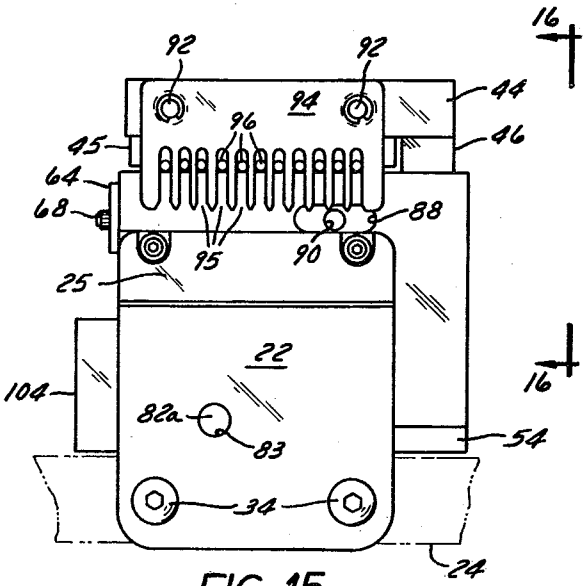
FIG. 15 is a side elevational view of the clamp assembly of FIG. 13, with the clamp arm in the lower position and the comb in an extended, wire engaging position, so as to straighten the ends of the wire leads in preparation for terminal attachment.
Figure 14:
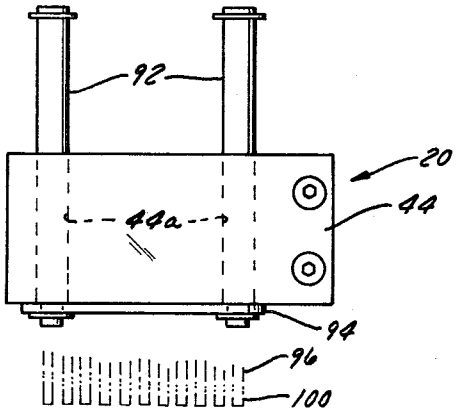
FIG. 14 is a top view of the clamp assembly of FIG. 13.
Figure 13:
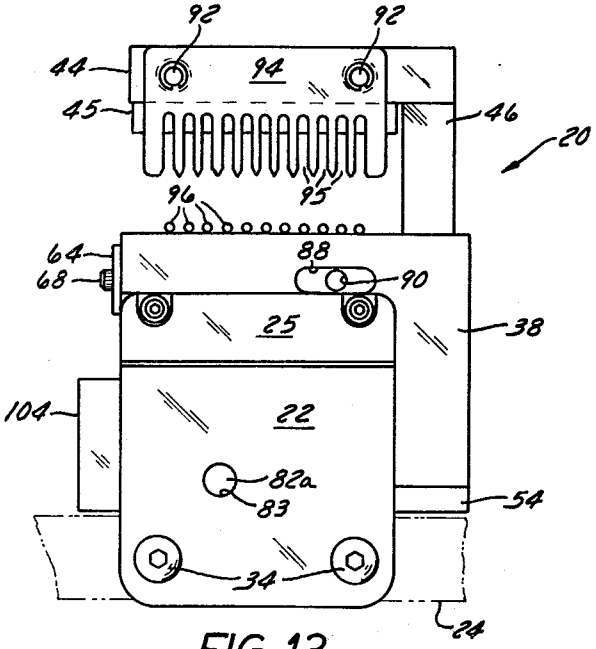
FIG. 13 is a side elevational view of a clamp assembly in accordance with the invention attached to a chain, with the clamp arm in its upper, free position, and with the comb in the retracted position.

After endless chain 24 stops, pusher means 98 acts upon the guide pin means 92 to cause the guide pin means and the comb 94 attached thereto to be pushed outwardly and transversely relative to the path formed by the chain (FIGS. 15 and 16). Upon lowering of the comb 94 with clamp arm 44 and prior to its movement in this outward and transverse direction, the comb engages the insulated portion of the wire leads 96 extending from a point adjacent the clamp arm and the clamp housing. As it moves outwardly and toward the wire ends, the comb 94 straightens the leads and provides for uniform spacing between the adjacent ends. After the pusher means 98 has moved the guide pin means 92 to the latter's predetermined limit of travel, which is somewhat beyond the transverse movement of the guide pin means shown in FIG. 2, the wires are attached to individual terminals or terminal block C and the pusher means 98 is retracted to enable retraction of the guide pin means 92 and comb 94 to their original positions (FIG. 1). The terminal attachment station may be the final processing station for the wire leads, which may be discharged from the clamp assembly. The retractible stop 106 is removed from the path of the clamp assembly, causing the now coiled spring 72 to recoil and push against pin 78 on clamp housing 38 to thereby return the clamp housing to its original psoition relative to the side plate support 22.

The chain 24 is restarted by automatic means therefor to move the assembly 20 towards the sprockets 28. As the assembly 20 begins to ride over sprocket 28 (FIG. 7), the lower end 86 of hammer arm 80 is contacted by a tooth 108 of that sprocket 28. The hammer arm 80 then pivots about shaft 82 in a counterclockwise direction (FIG. 7, hammer arm 84 in phantom) and the upper end 84 of hammer arm 80 forces the retaining pin to the left (direction with respect to FIGS. 6 and 7), disengaging that pin 58 from the orifice 56 of bar 46. Spring 50 forces bar 46 upwardly so that the clamp arm is returned to its original, upper, non-wire engaging free position (FIGS. 6 and 13), and the finished wire leads 96 fall downwardly under the force of gravity into a receptacle. The clamp assembly moves around sprocket 28 and travels along the lower flight of endless chain 24 until it reaches sprocket 26, where the cycle begins again as described above.

RECAPITULATION

The invention provides an apparatus and clamp assembly for separating the ends of a plurality of fine wires so as to ensure uniform spacing between adjacent wires and aid in the accurate attaching of the wire ends to terminals. The clamp assembly includes a side plate support rigidly secured to a drive chain and also includes a clamp housing that is slideably movable relative to the support so that the housing can be precisely aligned adjacent the wire processing stations notwithstanding any slack in the chain. The wire locating member or comb is secured to the clamp assembly rather than to the apparatus frame so that it may positively engage the wires near the side surfaces of the clamp housing and clamp arm, where the spacing between the wires is substantially uniform.

What I claim is:

1. A wire conveying clamp assembly for use in an apparatus for high-speed assembly of free ends of accurately sized wire leads to the terminals in a connector and of the type having an endless chain mounted on a pair of sprockets for rotation of said chain in a flat, orbital path, a plurality of said clamp assemblies secured to said chain for movement therewith, each of said assemblies including a side plate support fixedly attached to said chain, said side plate support having a clamp housing slidably attached thereto, said clamp housing being slideably mounted on and movable along said support in a direction parallel to the path of movement of said chain, said housing further having a vertically movable clamp arm slidably mounted thereon; said clamp arm having guide pin means slideably engaged therein, a comb attached to one end of said pin means and engaging said wire leads, pusher means for moving said comb and said guide pin means transversely relative to said chain path to thereby cause separation of said free ends of said wire leads.

2. The wire conveying clamp assembly set forth in claim 1, wherein said clamp arm is movable from an upper, non-wire engaging, free position, to a lower position wherein said clamp arm abuttingly engages the top of said clamp housing to thereby immobilize said wire leads between said clamp arm and said clamp housing.

3. The wire conveying clamp assembly set forth in claim 2, further comprising a bar to which one of the ends of said clamp arm is attached, and wherein said clamp housing further comprises a vertical slot, said bar being vertically slidably movable within said vertical slot to thereby permit movement of said clamp arm between said upper and lower positions.

4. The wire conveying clamp assembly set forth in claim 1, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said second pin is moved toward said first pin, said second pin abuts and compresses said spring and the latter abuts against said second pin to move said clamp housing to its original position relative to said side support.

5. The wire conveying clamp assembly set forth in claim 2, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said second pin is moved toward said first pin, said second pin abuts and compresses said spring and the latter abuts against said second pin to move said clamp housing to its original position relative to said side support.

6. The wire conveying clamp assembly set forth in claim 3, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said second pin is moved toward said first pin, said second pin abuts and compresses said spring and the latter abuts against said second pin to move said clamp housing to its original position relative to said side support.

7. The wire conveying clamp assembly set forth in claim 3, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

8. The wire conveying clamp assembly set forth in claim 4, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

9. The wire conveying clamp assembly set forth in claim 5, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

10. The wire conveying clamp assembly set forth in claim 6, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

11. The wire conveying clamp assembly set forth in claim 7, further comprising a hammer arm and a shaft, said hammer arm being pivotally movable about said shaft, said shaft being secured to said side plate support, said hammer arm being of substantially L-shape and having an upper end for engaging said retaining pin and also having a lower end, said lower end being strikable by one of said sprockets to cause said pivotal movement whereby said upper end of said hammer arm releases said retaining pin from its extensible engagement with said orifice in said bar.

12. In an apparatus for high-speed assembly of free ends of accurately sized wire leads to the terminals in a connector and of the type having an endless chain mounted on a pair of sprockets for rotation of said chain in a flat, orbital path, a plurality of clamp assemblies secured to said chain for movement therewith, each of said assemblies including a side plate support fixedly attached to said chain, said side plate support having a clamp housing slidably attached thereto, said clamp housing being slideably mounted on and movable along said support in a direction parallel to the path of movement of said chain, said housing further having a vertically movable clamp arm slidably mounted thereon; said clamp arm having guide pin means slideably engaged therein, a comb attached to one end of said pin means and engaging said wire leads, pusher means for moving said comb and said guide pin means transversely relative to said chain path to thereby cause separation of said free ends of said wire leads; said apparatus further including a stop for abuttingly engaging a front portion of said clamp housing to thereby cause slideable movement of said clamp housing along said side support and accurately position said clamp housing and said free ends adjacent said terminal to which said leads are to be secured.

13. The apparatus set forth in claim 12, wherein said clamp arm is movable from an upper, non-wire engaging, free position, to a lower position wherein said clamp arm abuttingly engages the top of said clamp housing to thereby immobilize said wire leads between said clamp arm and said clamp housing.

14. The apparatus set forth in claim 13, further comprising a bar to which one of the ends of said clamp arm is attached, and wherein said clamp housing further comprises a vertical slot, said bar being vertically slidably movable within said vertical slot to thereby permit movement of said clamp arm between said upper and lower positions.

15. The apparatus set forth in claim 12, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said clamp housing abuts said stop and slideably moves along said side support, said second pin abuts and compresses said spring, and whereby after said stop is removed from abutting engagement with said clamp housing, said spring abuts against said second pin to move said clamp housing to its original position relative to said side support.

16. The apparatus set forth in claim 13, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said clamp housing abuts said stop and slideably moves along said side support, said second pin abuts and compresses said spring, and whereby after said stop is removed from abutting engagement with said clamp housing, said spring abuts against said second pin to move said clamp housing to its original position relative to said side support.

17. The apparatus set forth in claim 14, wherein said side plate support further comprises a substantially horizontally oriented spring attached along said support, said side plate support further comprising a first pin attached thereto and abutting one end of said spring, and said clamp housing further comprising a second pin for abutting the other end of said spring, whereby as said clamp housing abuts said stop and slideably moves along said side support, said second pin abuts and compresses said spring, and whereby after said stop is removed from abutting engagement with said clamp housing, said spring abuts against said second pin to move said clamp housing to its original position relative to said side support.

18. The apparatus set forth in claim 14, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

19. The apparatus set forth in claim 15, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

20. The apparatus set forth in claim 16, wherein said clamp arm is maintained in said lower position by a spring-biased retaining pin within said clamp housing, said retaining pin being substantially horizontally oriented, said bar further comprising an orifice, said retaining pin extending through said orifice when said calmp arm is in said lower position to thereby prevent upward movement of said bar and said clamp arm.

21. The apparatus set forth in claim 17, wherein said clamp arm is maintained in said lower position by a spring-biased retaining pin within said clamp housing, said retaining pin being substantially horizontally oriented, said bar further comprising an orifice, said retaining pin extending through said orifice when said clamp arm is in said lower position to thereby prevent upward movement of said bar and said clamp arm.

22. The apparatus set forth in claim 18, further comprising a hammer arm and a shaft, said hammer arm being pivotally movable about said shaft, said shaft being secured to said side plate support, said hammer arm being of substantially L-shape and having an upper end for engaging said retaining pin and also having a lower end, said lower end being strikable by one of said sprockets to cause said pivotal movement whereby said upper end of said hammer arm releases said retaining pin from its extensible engagement with said orifice in said bar.

23. In an apparatus for high speed assembly of free ends of accurately sized wire leads to the terminals in a connector and of the type having an endless chain mounted on a pair of sprockets for rotation of said chain in a flat, orbital path, a plurality of clamp assemblies secured to said chain for movement therewith, each of said assemblies including a side plate support fixedly attached to said chain, said side plate support having a clamp housing slideably attached thereto, said clamp housing being slideably mounted on and movable along said support in a direction parallel to the path of movement of said chain, said housing further having a vertically movable clamp arm slidably mounted thereon, and further comprising a bar to which one of the ends of said clamp arm is attached; said clamp housing including a vertical slot, said bar being spring biased and vertically slidably movable within said vertical slot, said bar further comprising a projection at the lower end thereof, said clamp arm being movable with said bar from an upper, non-wire engaging free position, said projection limiting the upward movement of said bar and clamp arm by abutting said clamp housing, to a lower position wherein said clamp arm abuttingly engages the top of said clamp housing to thereby immobilize said wire leads between said clamp arm and said clamp housing, said bar further comprising an orifice, and said clamp housing further comprising a spring-biased retaining pin, said retaining pin being substantially horizontally oriented, said retaining pin extending through said orifice when said clamp is in said lower positon to thereby prevent upward movement of said bar and said clamp arm; said apparatus further comprising a hammer arm and a shaft, said hammer arm being pivotally movable about said shaft, said shaft being secured to said side plate support, said hammer arm being of substantially L-shape and having an upper end for engaging said retaining pin and also having a lower end, said lower end being strikable by one of said sprockets to cause said pivotal movement whereby said upper end of said hammer arm releases said retaining pin from its extensible engagement with said orifice in said bar; said clamp arm having guide pin means slideably engaged therein, a comb attached to one end of said pin means and engaging said wire leads, pusher means for moving said comb and said guide pin means transversely relative to said chain path to thereby cause separation of said free ends of said wire leads; said apparatus further including a retractable stop for abuttingly engaging a front portion of said clamp housing to thereby cause slideable movement of said clamp housing along said side support and accurately position said clamp housing and said free ends adjacent said terminal to which said leads are to be secured; said side plate support further comprising a substantially horizontally oriented spring attached along said support, and a first pin attached thereto and abutting one end of said spring, and said clamp housing further comprising a second pin for abutting the other end of said spring, whereby as said clamp housing abuts said stop and is slideably moved along said side support, said second pin abuts and compresses said spring, and whereby after said stop is removed from abutting engagement with said clamp housing, said spring recoils against said second pin to move said clamp housing to its original position relative to said side support.

* * * * *